United States Patent [19]

Blohm et al.

[11] Patent Number: 4,561,345

[45] Date of Patent: Dec. 31, 1985

[54] PNEUMATIC SETTING DEVICE

[75] Inventors: Knud Blohm; Hans P. B. Petersen, both of Nordborg, Denmark

[73] Assignee: Danfoss A/S, Nordborg, Denmark

[21] Appl. No.: 664,759

[22] Filed: Oct. 25, 1984

Related U.S. Application Data

[63] Continuation of Ser. No. 528,617, Sep. 1, 1983, abandoned.

[30] Foreign Application Priority Data

Sep. 22, 1982 [DE] Fed. Rep. of Germany ..... 3235015

[51] Int. Cl.[4] ..... F15B 13/04

[52] U.S. Cl. ..... 91/459; 91/465; 137/596.17; 137/625.65

[58] Field of Search ..... 91/459, 465; 137/596.17, 625.65; 92/48

[56] References Cited

U.S. PATENT DOCUMENTS

| | | | |
|---|---|---|---|
| 2,000,890 | 5/1935 | Hueber et al. | 92/48 |
| 2,976,085 | 3/1961 | Grogan | 91/459 |
| 4,349,045 | 9/1982 | Kah, Jr. | 137/625.65 |
| 4,369,696 | 1/1983 | Klatt et al. | 137/596.17 |
| 4,403,765 | 9/1983 | Fisher | 137/625.65 |

*Primary Examiner*—Robert E. Garrett
*Assistant Examiner*—John M. Husar
*Attorney, Agent, or Firm*—Wayne B. Easton

[57] ABSTRACT

The invention relates to a pneumatic setting device having oppositely operable magnetic valves for alternately pressurizing and exhausting expansible chambers formed by one or more diaphragms to which a reciprocatable setting element is attached. In this construction a return spring may be omitted.

1 Claim, 6 Drawing Figures

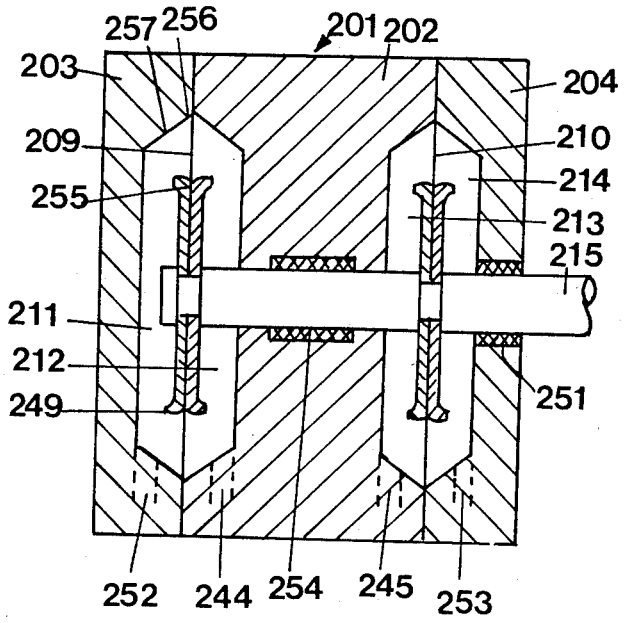
Fig.5
Fig.6
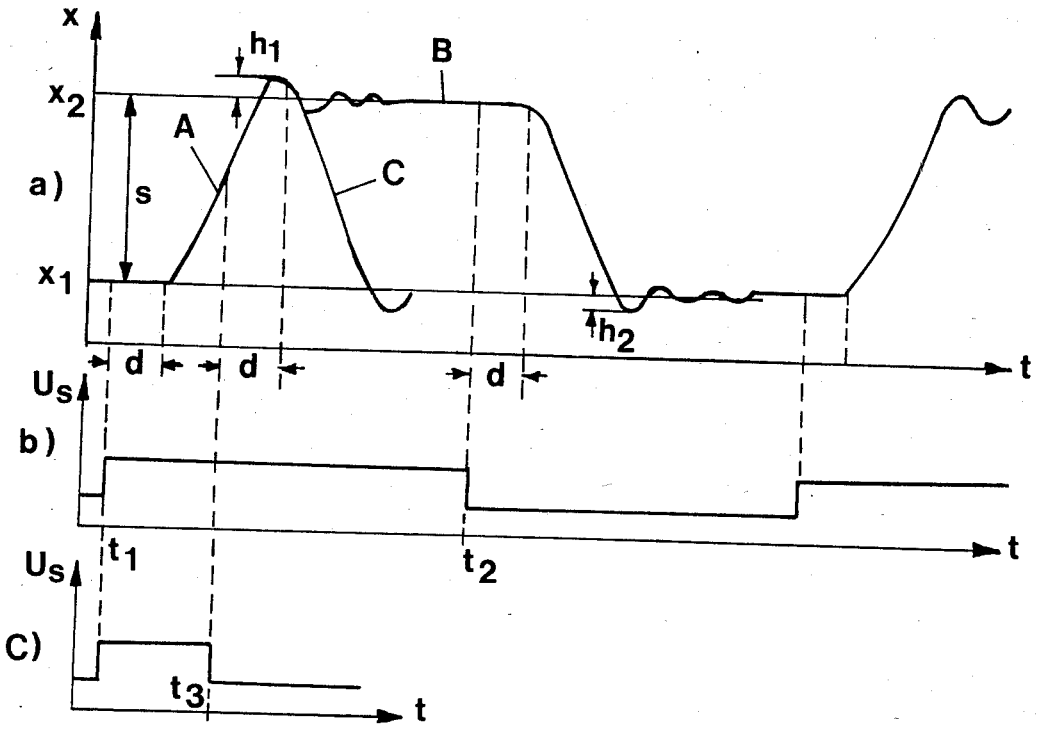

PNEUMATIC SETTING DEVICE

This application is a continuation of application Ser. No. 528,617, filed Sept. 1, 1983, now abandoned.

The invention relates to a pneumatic setting device comprising a housing which, together with a movable wall connected to a setting element, bounds a pressure chamber, and two magnetic valves adjacent to the pressure chamber, the latter being selectively connectible by the one magnetic valve to one of two connections at different pressures.

In a known setting device of this kind (DE-OS No. 24 23 516), a single pressure chamber is bounded by the housing, corrugated bellows and a stiff end wall connected to the setting element. The housing carries two magnetic valves having axial passages with their axes extending in parallel adjacent to each other. The one magnetic valve has an inlet connected to the surroundings and an inlet connected to a vacuum pump. An armature in the form of a flat closing member is reciprocatable between two closely spaced valve seats to facilitate rapid operation. The chamber beyond the valve seat is connected to the pressure chamber by way of a throttle. A return spring holds the end wall in the one limiting position. By actuating the first magnetic valve, there is a vacuum in the pressure chamber so that the movable end wall moves to the other limiting position. The speed of movement is limited because the vacuum must first overcome the force of the return spring. Simultaneously with changing over the first magnetic valve, the hitherto closed second magnetic valve moves to a position in which the surroundings are connected to the pressure chamber without any effective throttling. The atmosphere can therefore reach the pressure chamber by way of two parallel paths. This speed of movement is likewise limited because, by reason of the movement effected by the vacuum, the return spring cannot be designed to be too strong.

The invention is based on the problem of providing a setting device of the aforementioned kind in which the operating stroke can be executed at a higher speed.

This problem is overcome according to the invention by the following features:

(a) the movable wall is a diaphragm clamped in the housing;

(b) a second pressure chamber bounded by a diaphragm connected to the setting element and the housing has an operating direction opposite to the first pressure chamber;

(c) the second pressure chamber is selectively feedable by way of the second magnetic valve with the pressure of one of the two connections, and (d) the two magnetic valves are operable in opposite senses.

In this construction, a return spring can be partially or entirely omitted. The second pressure chamber is available for the return movement. Since the force of the return spring does not have to be overcome, the operating speed for forward motion is higher. Since, with the aid of the oppositely operable magnetic valves, the conditions are merely reversed for the return motion, the same high operating speed is in this case again achieved. In contrast with conventional change-over valves, in which comparatively large masses have to be moved and long distances covered, the magnetic valve combination operates just as rapidly as a single magnetic valve. The valve construction therefore likewise facilitates rapid operation. In addition, the diaphragm provides a large area in relation to the weight so that correspondingly large accelerating forces can become effective.

Tests have shown that it is in this way possible to achieve changeover periods in the order of 10 ms. One can therefore carry out individual strokes at a very high operating speed as well as achieve repeated operating strokes at a very high operating frequency. The pneumatic setting device can, for example, be employed for carrying out an operation on a machine tool, for a feeding mechanism, a step drive or the like. It may serve to drive an apparatus for punching or cutting, for example plastic bags, for closing packages, for printing small printed matter such as labels, for ejecting workpieces, for changing points in conveying paths, and the like.

It is particularly advisable for the two pressure chambers to be disposed at both sides of the same diaphragm. This results in a very simple construction. One can also connect a plurality of such diaphragms in parallel and to the setting element.

Another possibility is for the two pressure chambers to be disposed at the confronting sides of two diaphragms which, together with the housing, bound a respective third and fourth pressure chamber constantly maintained at ambient pressure. This achieves the same effect but the pressure chamber for leading the setting element outwardly is at ambient pressure. There is then no danger that air from the surrounding atmosphere will pass through the lead-through seal for the setting element and enter the adjacent pressure chamber. The setting device can therefore also be used when there is a danger of the atmosphere containing harmful components that might destroy the diaphragm or the remainder of the system when it penetrates the device.

The setting device can operate at a pressure as well as vacuum. It is particularly favourable, however, for the first connection to be connectible to a vacuum source and the second to a pressure source. In this case, the diaphragm will be subjected to a very large pressure difference in both directions of movement, thereby increasing the operating speed still further.

From a constructional point of view, it is preferred for the housing to comprise a base member and a cover member which clamp the diaphragm between each other and have confronting recesses for defining two pressure chambers and of which at least one member is sealingly traversed by the setting element in the form of a rod. This facilitates rapid assembly and short passages between the pressure chambers and the magnetic valves arranged in the housing.

It is also possible to provide on the side of the base member opposite to the cover member a second cover member for clamping the second diaphragm and here again provide two confronting recesses defining two pressure chambers. In this way, it is possible to duplicate the diaphragms at little expense, either to operate in parallel or to use one pressure chamber as a protecting chamber at ambient pressure.

If the magnetic valves have an axial passage and access at both axial ends, it is favourable for bores provided in the base member for receiving the two magnetic valves to have parallel axes in a plane normal to the axis of the setting element and to extend on both sides of said setting element axis, and for at least one connection to be connected by way of a main passage extending in said plane normal to the magnetic valve axes to the accesses of both magnetic valves disposed on the same side. In this construction, one obtains very small dimensions without interference between the individual bores and passaages.

If the magnetic valves have an armature in the form of a flat closing member reciprocatable between two closely spaced valve seats, it is advantageous for a transverse passage to extend from the chamber beyond the valve seats to lead to a connecting bore parallel to the setting element axis. This connecting bore will then be normal to the surface between the base member and cover member. It can open directly into the one pressure chamber or be extended in the cover member.

If both magnetic valves are associated with throttling means adjustable at least for the supply of the one pressure, it is possible to achieve particularly good adaptation to the operating conditions.

Abutments on the setting element or a part connected thereto may co-operate with parts fixed with respect to the housing to limit the stroke of the setting element. A defined stroke facilitates more accurate operation. The abutments may be of a damping construction to minimize noise.

In a preferred embodiment, however, the abutments are of a low-damping material and there are means for setting the instant of changeover of the magnetic valves in relation to abutment of the abutments with the part fixed with respect to the housing. This permits still higher operating speeds for applications where the setting element must be returned immediately after reaching its limiting position. It is merely necessary to ensure that the magnetic valves will change over at that instant at which the setting element springs back after striking the abutment.

It is also favourable for the diaphragm to be connected to the setting element by supporting plates which clamp the diaphragm from both sides and have magins bent away from each other, for the recesses to have oblique faces at the clamping position, and for all the magins and oblique faces to merge with the diaphragm clamping faces with a radius. This construction leads to a long life.

Preferred examples of the invention will now be described in more detail with reference to the drawing, wherein:

FIG. 5 is a section through a further embodiment of the invention, and

FIG. 6 shows time diagrams for the path of the setting element and the course of the associated control voltages.

Figure 1:
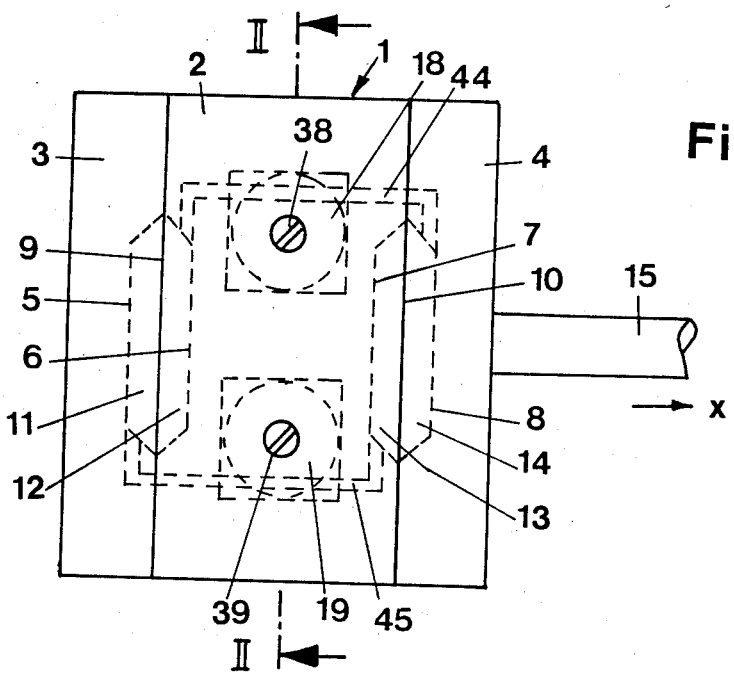
FIG. 1 is a plan view of a setting device according to the invention.

In the FIG. 1 embodiment, a housing 1 has a base member 2, a first cover member 3 and a second cover member 4 which, at the confronting end faces, each have a recess 5, 6, 7 and 8. A diaphragm 9 is clamped between the base member 2 and cover member 3, and a diaphragm 10 is clamped between the base member 2 and cover member 4. This results in four pressure chambers 11, 12, 13 and 14. Both diaphragms 9 and 10 are connected to a setting element 15 in the form of a rod.

Figure 2:
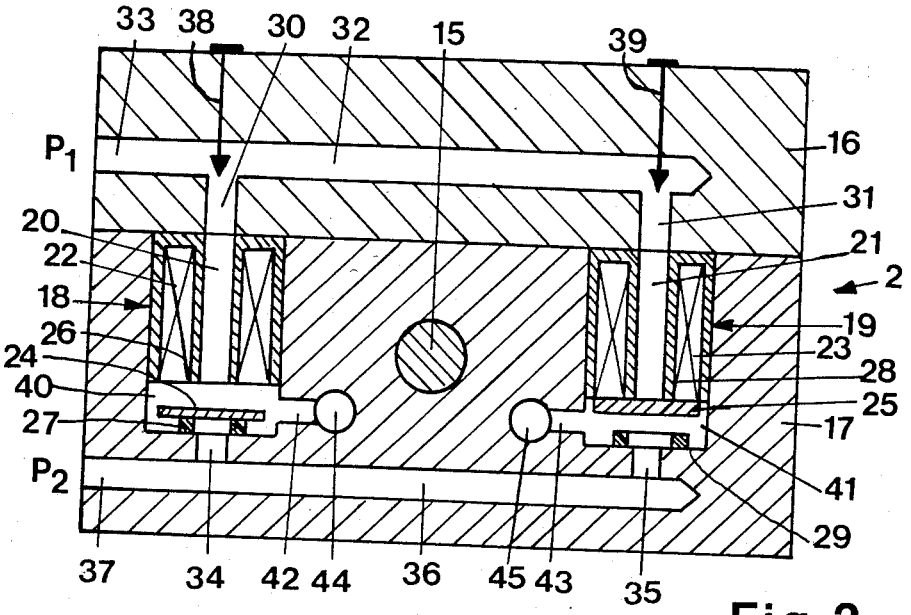
FIG. 2 is a slightly modified diagrammatic section on the line II—II in FIG. 1.

As shown in FIG. 2, the base member 2 consists of two blocks 16 and 17 in which there are provided two magnetic valves 18 and 19 each with a through passage 20, 21, and exciter coil 22, 23, and a plate-shaped armature 24, 25, respectively. The armature 24 forms a closing member which selectively co-operates with a valve seat 26 and a valve seat 27 and the armature 25 forms a closing member which selectively co-operates with a valve seat 28 and a valve seat 29. The upper inlets 30 and 31 of the two magnetic valves 18 and 19 are connected to a first main passage 32 of which the connection 33 is fed with a pressure $P_1$ higher than ambient pressure. The two other inlets 34 and 35 of magnetic valves 18 and 19 are connectd to a second main passage 36 of which the connection 37 is fed with a pressure $P_2$ below ambient pressure. Two adjustable throttle means 38 and 39 permit the effective pressure to be adapted to particular requirements. The armatures 24 and 25 move in annular chambers 40 and 41, respectively, from which there extend transverse passages 42 and 43 leading to connecting passages 44 and 45 which, in turn, are connected to the four pressure chambers 11, 12, 13 and 14. For the sake of clarity, these passages are illustrated in FIG. 2 within the magnetic valve axes.

As is shown in FIG. 2, the armatures 24, 25 of magnetic valves 18 and 19 have a respective opposite position. For example, the magnetic valve 19 is energised so that the armature 25 covers valve seat 28. Consequently, the pressure chambers 11 and 13 are connected to the vacuum $P_2$. On the other hand, armature 24 of magnetic valve 18 covers valve seat 27. Consequently, the pressure chambers 12 and 14 are connected to the pressure $P_1$. The setting element 15 therefore assumes its left-hand limiting position in FIG. 1. On reversing the two magnetic valves 18 and 19, the pressure conditions are reversed, i.e. pressure chambers 11 and 13 are at the pressure $P_1$ and pressure chambers 12 and 14 are at the vacuum $P_2$. The setting element 15 is subjected to the relatively large pressure difference and rapidly moves to the right-hand limiting position.

Figure 3:
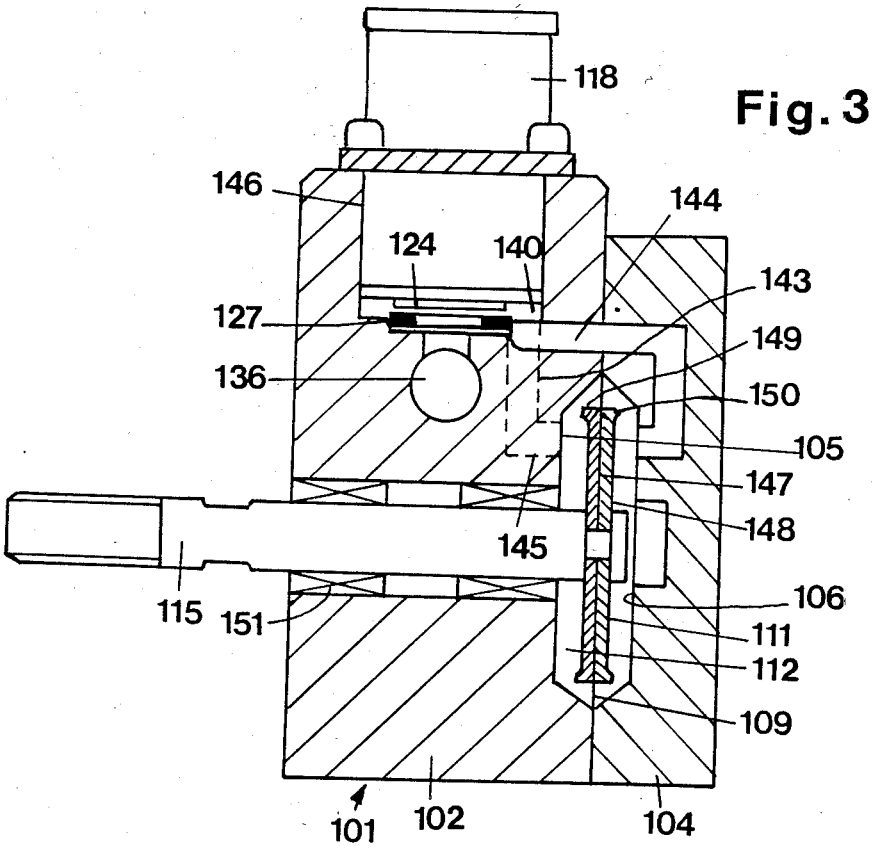
FIG. 3 is a section on the line III—III in FIG. 4 of a different embodiment of the invention.
Figure 4:
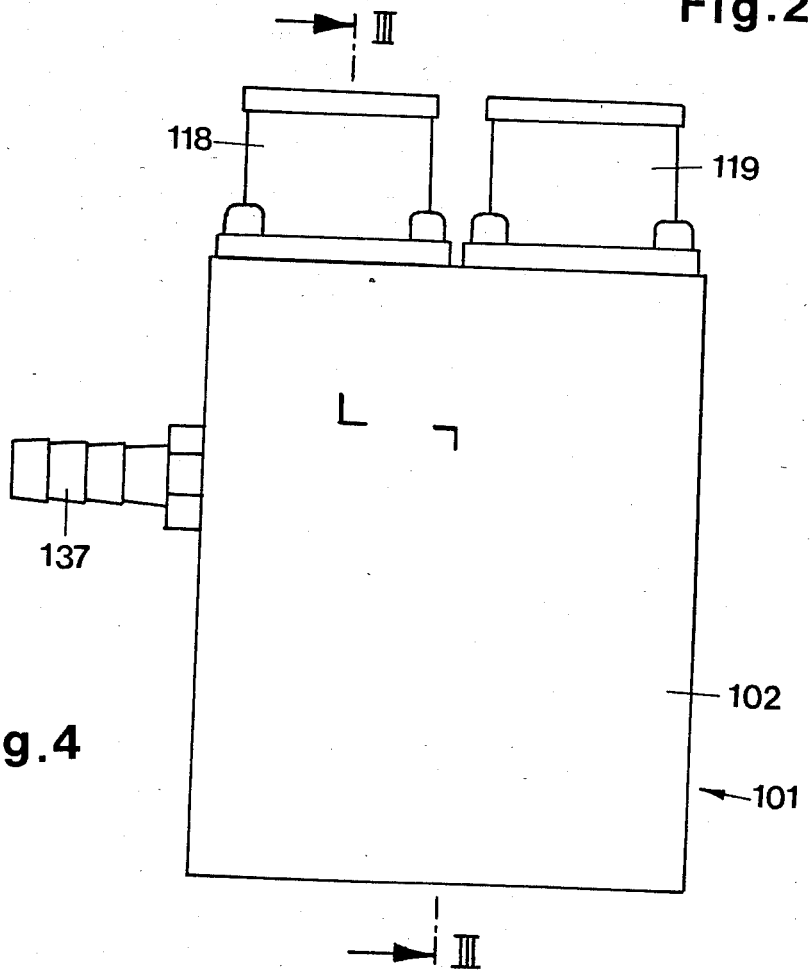
FIG. 4 is a side elevation of the FIG. 3 embodiment.

In the embodiment of FIGS. 3 and 4, the same reference numerals increased by 100 are used for corresponding components. The base member 102 is here in one piece. The two magnetic valves 118 and 119 are disposed in bores 146 which open to the outside. The outer margin of diaphragm 109 is clamped between the base member 102 and cover member 104. Its central portion is clamped between two supporting plates 147 and 148 connected to the setting element 115. The supporting plates have margins 149 and 150 which at the same time serve as abutments for limiting the stroke of the second element. A seal 151 serves for the pressure-tight passage of the setting element 115 through the housing 101.

The connection 137 is connected either to a source of compressed air or to a source of suction air. The inlets of magnetic valves 118 and 119 opposite the main passage 136 communicate directly with the atmosphere. In operation, the pressure chambers 111 and 112 are alternately connected to the connection 137 whereas the respective other pressure chamber communicates with the atmosphere. This results in rapid movement of the setting element 115.

In the FIG. 5 embodiment, the reference numerals for corresponding parts are increased by a further 100. The arrangement corresponds to that of FIG. 1 except that the pressure chambers 211 and 214 are constantly connected by way of their connecting conduits 252 and 253 to a connection to which ambient pressure is supplied. This has the consequence that no pressure difference must be balanced out by the seal 251 and no surrounding air can penetrate into the pressure chamber 214, as would be possible if the latter were at a vacuum. The setting device can therefore also be used in rooms where harmful vapours or explosive mixtures may occur.

This figure also shows that there is a second seal 254 between the pressure chambers 212 and 213 and that a radius for protecting the diaphragms 209 and 210 is provided wherever the diaphragm 209 and 210 emerges from the clamping points, namely at the root 255 of the margins 249 and at the root 256 of the oblique faces 257 of the recesses.

In FIG. 6*a*, the distance x of setting element 15 is shown against time t and in FIGS. 6*b* and 6*c* the control voltage $U_s$ fed to the one magnetic valve is shown against time. A reverse curve will be applicable to each other respective magnetic valve. The points $x_1$ and $x_2$ characterise the limiting positions of setting element 115 as defined by the abutments 149, 150, thus resulting in a total stroke s.

Considering the magnetic valve 18 in FIG. 2, if at the instant $t_1$ the control voltage $U_s$ is increased above the attracting value, following a delay d the setting element moves in accordance with the rising limb A of the graph. When the abutment 149 strikes the housing, there is an overswing by the amount $h_1$. If the control voltage $U_s$ has the course shown in FIG. 6*b*, the graph portion B results after damped oscillation. If the control voltage is switched over at the instant $t_2$, the procedure is continued in the reverse direction with a delay d, thereby resulting in overswinging by the amount $h_2$ in the opposite limiting position. In contrast, if in accordance with FIG. 6*c* the control voltage $U_s$ is already reduced at the instant $t_3$, the opposite movement in accordance with branch C of the graph will occur earlier after the delay d. The instant $t_3$ is set so that the return movement already starts upon first swinging back in the region of the limiting position $x_2$, thereby resulting in a very rapid return motion to the limiting position $x_1$.

Conventional valves may be employed for the magnetic valves. If the position of installation may be different, the armatures 24, 25 should be provided with a return spring which biasses them off the valve seat 26 or 28.

We claim:

1. A pneumatic setting device comprising, expansible chamber means, a housing having pressure supply and exhaust passage means, a first solenoid valve unit in said housing including a solenoid coil forming a central unobstructed fluid passage substantially coextensive with the length and internal diameter of said solenoid coil, said first solenoid valve unit including a fluid distribution chamber axially adjacent said coil having aligned supply and exhaust ports with one of said ports being for said coil central fluid passage, said first solenoid valve unit including valve seats for said ports and an armature in the form of a flat disk shaped closure member fully contained in said distribution chamber which is reciprocatable between said valve seats, a second solenoid valve unit in said housing substantially similar to said first solenoid valve unit, said housing have passage means connecting said distribution chamber supply and exhaust ports with said housing supply and exhaust passage means, said housing have a pair of control passages connectable to opposite sides of said expansible chamber means, said housing having passage means fluidly connecting said distribution chambers of said first and second solenoid units respectively to said control passages, and said first and second valve units being oppositely operable to connect said supply passage means to one of said control passages concomitant with connecting said exhaust passage means to the other of said control passages.

* * * * *